United States Patent [19]

Seyffert et al.

[11] 4,420,107

[45] Dec. 13, 1983

[54] LEAD FRAME ADVANCE SYSTEM

[75] Inventors: Michael Seyffert, Santa Cruz; Alan F. d'Entremont, Sunol, both of Calif.

[73] Assignee: National Semiconductor Corp., Santa Clara, Calif.

[21] Appl. No.: 349,954

[22] Filed: Feb. 18, 1982

[51] Int. Cl.[3] ..... B65H 23/16; B65H 25/02; B65H 17/22

[52] U.S. Cl. ..... 226/32; 226/35; 226/36; 226/45; 226/138; 226/154; 226/174

[58] Field of Search ..... 226/24, 32, -36, 226/45, 120, 137-139, 152, 154, 155, 168, 174

[56] References Cited

U.S. PATENT DOCUMENTS 3,765,583 10/1973 Mathes ..... 226/36
3,877,627 4/1975 Boase et al. ..... 226/33

*Primary Examiner*—Leonard D. Christian
*Attorney, Agent, or Firm*—Gail W. Woodward; Paul J. Winters; Michael J. Pollock

[57] ABSTRACT

To cut a strip of metal into exact lengths, rollers are brought into contact with the strip and turned by an accurate motor until a pin can be mechanically inserted into a hole in the strip to effect final alignment. If the pin does not successfully enter the hole, a detector halts the system.

4 Claims, 2 Drawing Figures

LEAD FRAME ADVANCE SYSTEM

BACKGROUND OF THE INVENTION

Semiconductor chips and the like are mounted on lead frames to provide a plurality of electrical connection leads thereto. Lead frames are manufactured in the prior art from a ribbon or strip of metal comprising a multitude of these frames. It becomes desirable to cut this strip at one stage of production, into convenient lengths of exact size. To insure that the lead frame advances incrementally by the correct distance along its length, and stops just at the precise location under a cutting shear, requires complex mechanical systems which either grasp the strip and index it forward in one stroke or roll the strip under high pressure rollers that may deform and stretch the strip. Neither system is as accurate as would be desirable and neither system allows a convenient change in the length of the incremental advance. The present invention is both accurate and easily adjustable.

SUMMARY OF THE INVENTION

Briefly, the system herein disclosed utilizes a highly accurate stepping motor connected to pinch rollers that engage the strip to move it the approximate correct distance. A final adjustment mechanism then takes over to insert a pin into a hole in the lead frame and adjust the lead frame fore and aft to the exact right location. The overall predetermined stroke or distance is easily adjusted electronically by a control system that selects the correct number of steps for the stepping motor to turn. Since reliance is not placed on the motor for exactitude, it need not grasp the strip as hard and, hence, this invention permits the use of an elastomer traction material on one of the pinch rollers.

Splices in lead frame cause slight changes in length, so that the final alignment pin may miss a hole. If this happens, a light beam detects that failure and shuts down the system. Additional advantages and improvements will become apparent upon consideration of the detailed description that follows.

DESCRIPTION OF THE PREFERRED EMBODIMENT

Figure 1:
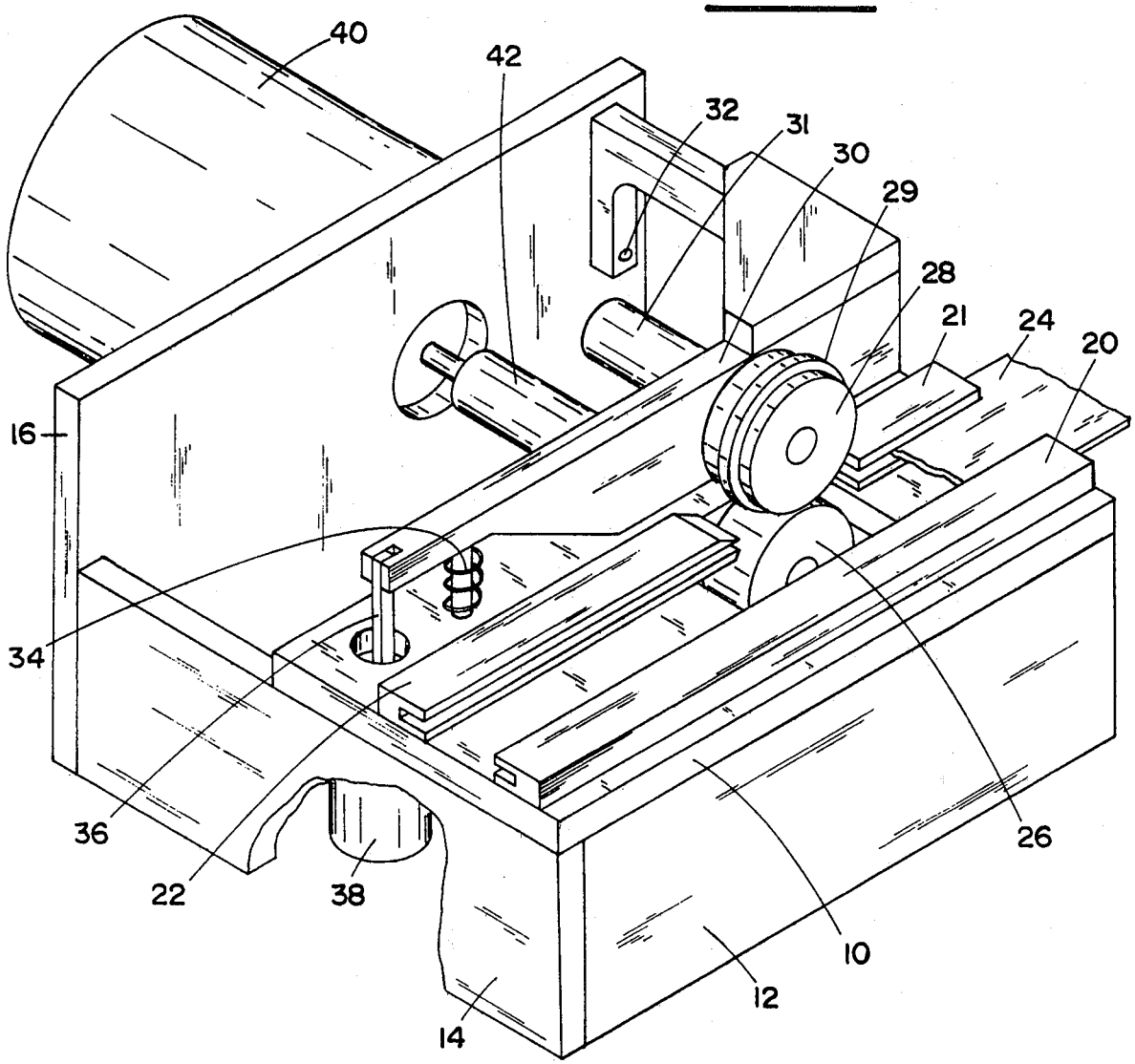
FIG. 1 is a view which schematically shows one arrangement of the mechanical pinch roller advance mechanism of this invention.

In FIG. 1, a platform 10 is shown supported by brackets 12 and 14. A rear bracket 16 assists in supporting the movable elements of the device. Three slotted guides 20, 21, and 22 create a channel through which the lead frame 24 passes. Lead frame 24 is cut away in the drawing to enhance visibility, but would normally pass between a pair of pinch rollers 26 and 28. The upper pinch roller 28 may utilize an elastomer traction material 29 disposed in a groove about the periphery of roller 28 to insure slip free contact with strip 24. Roller 28 is movably carried by a swing arm 30 and bearing 31. Swing arm 30 pivots on bracket 16 at pivot 32 and on platform 10 by a pivot not visible in FIG. 1.

Roller 28 may be lowered into firm contact with strip 24 by a solenoid 38 that pulls swing arm 30 downward, with a connecting link 36, against the action of a spring 34. Only roller 26 is driven, deriving its motive power from a highly accurate stepping motor 40 through a drive shaft 42. Roller 28 turns because it is geared to roller 26 as can be better seen in FIG. 2.

Figure 2:
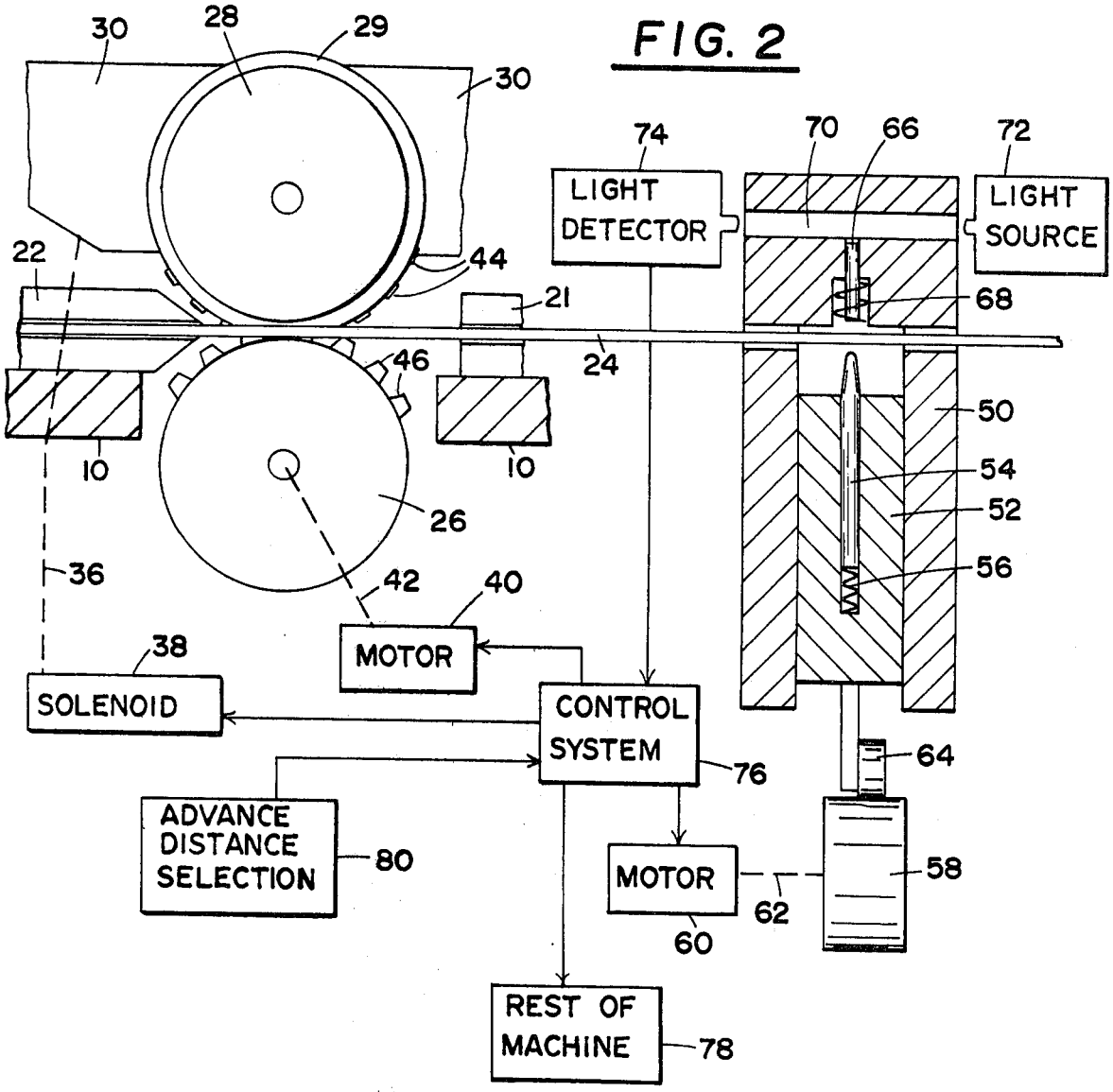
FIG. 2 is a view which schematically shows the control system and the final alignment system of the invention.

FIG. 2 shows just the pinch rollers 26 and 28, platform 10, and the guides 21 and 22 from FIG. 1. A series of gear teeth 44 on roller 28 remain meshed with a series of gear teeth 46 on driven roller 26. Dimensions are chosen so that when solenoid 38 operates through link 36 (shown as a dashed line in FIG. 2) to pull down swing arm 30 and roller 28, elastomer 29 creates a snug high friction contact with strip 24 and gear teeth 44 and 46 engage each other fully rather than just loosly. Hence, both rollers may be turned by motor 40 so as to advance strip 24 a selected distance once solenoid 38 is operated to engage the rollers with the strip.

The final exact alignment of strip 24 is effected by the pin insertion means on the right of FIG. 2. A housing 50, shown in section, contains a sliding pin carrier 52. Inside carrier 52 is a slidable pin 54 springably positioned by a relief spring 56. A cam 58, turned by a motor 60 and a mechanical connection 62, lifts up on a cam follower 64 to raise carrier 52. A series of precisely located holes are normally provided in the edge of strip 24. The conical head of pin 54 enters the hole and, upon complete entry, mechanically moves the strip 24 to the correct position. Complete entry is detected by a pin 66 springably positioned in housing 50 by a spring 68. If pin 54 passes fully though the hole in strip 24, it contacts the bottom of pin 66 so that pin 66 rises up and blocks the passage of light through a path 70 from a source 72. The absence of light at a detector 74 is used to signal a control system 76 that alignment has been successfully accomplished. If the strip 24 was not moved the correct distance by motor 40, or a splice or deformity has changed the length of the strip, the hole in strip 24 will be misaligned. Pin 54 will not be able to pass through but will simply compress spring 56 and no light in path 70 will be interrupted.

Control system 76 may comprise, for example, a programmed microprocessor, or the like, that operates to first activate solenoid 38 so as to engage the rollers with the strip. Next, stepping motor 40 is activated and driven a certain number of steps, in accordance with an advance distance selection means 80, so as to turn rollers 26 and 28 the correct amount to move strip 24 the selected advance distance. Next, control system 76 permits motor 60 to keep turning cam 58 and thus raise pin 54 to make the final position alignment. Then, system 76 waits for a signal from detector 74 indicating successful final alignment. If that signal is received, control system 76 operates the rest of the machine 78, which may comprise, for example, means to cut the strip, means to feed strip, means to unload cut strip, and other such ancillary apparatus.

I claim:

1. A lead frame incremental advance system for moving a continuous strip of lead frame along its length by a predetermined adjustable distance comprising in combination:

roller means adapted to frictionally contact said lead frame comprising first and second pinch rollers on both sides of the lead frame, said first pinch roller connected to be driven by said motor means and having gear teeth thereon, said second pinch roller also having gear teeth thereon positioned to engage the gear teeth on the first roller so as to be driven by said first roller;

engagement means operable to move said roller means into contact with said lead frame;

motor means connected to said roller means so as to turn said roller means and advance said lead frame when said roller means is in contact with said lead frame;

final alignment means adapted to cooperate with holes at known positions in said lead frame, after the lead frame is advanced by said roller means, so as to mechanically move the lead frame to the correct final position; and control means connected to said motor means, said final alignment means and said engagement means so as to first cause said engagement means to move said roller means, secondly cause said motor means to turn said roller means and advance the lead frame a predetermined distance, and finally operate the final alignment means.

2. A lead frame incremental advance system for moving a continuous strip of lead frame along its length by a predetermined adjustable distance comprising in combination:

roller means adapted to frictionally contact said lead frame;

engagement means operable to move said roller means into contact with said lead frame;

motor means connected to said roller means so as to turn said roller means and advance said lead frame when said roller means is in contact with said lead frame;

final alignment means adapted to cooperate with holes at known positions in said lead frame, after the lead frame is advanced by said roller means, so as to mechanically move the lead frame to the correct final position, said final alignment means comprising a spring loaded pin adapted to enter said holes, and, upon doing so, move another pin into a light blocking path, and including light detection means at one end of said path connected to said control means so as to signal thereto a successful entry of said final alignment means into said holes; and control means connected to said motor means, said final alignment means and said engagement means so as to first cause said engagement means to move said roller means, secondly cause said motor means to turn said roller means and advance the lead frame a predetermined distance, and finally operate the final alignment means.

3. The system of claim 1 including elastomer traction material on said second pinch roller.

4. The system of claim 2 including elastomer traction material on said second pinch roller.

* * * * *